US010460553B2

(12) United States Patent
Chan et al.

(10) Patent No.: US 10,460,553 B2
(45) Date of Patent: Oct. 29, 2019

(54) METHODS OF USER AND MACHINE INTERACTION AND APPARATUS FOR FACILITATING USER INTERACTION

(71) Applicant: Takara Gaming Solutions Limited, Hong Kong (HK)

(72) Inventors: Yui Man Raymond Chan, Hong Kong (HK); Ka Lun Ernie Suek, Hong Kong (HK)

(73) Assignee: Takara Gaming Solutions Limited, Hong Kong (HK)

( * ) Notice: Subject to any disclaimer, the term of this patent is extended or adjusted under 35 U.S.C. 154(b) by 200 days.

(21) Appl. No.: 15/851,738

(22) Filed: Dec. 21, 2017

(65) Prior Publication Data

US 2018/0182203 A1 Jun. 28, 2018

(30) Foreign Application Priority Data

Dec. 22, 2016 (HK) ..... 16114622.9

(51) Int. Cl.
*G07F 17/32* (2006.01)

(52) U.S. Cl.
CPC ..... *G07F 17/3213* (2013.01); *G07F 17/323* (2013.01); *G07F 17/3288* (2013.01)

(58) Field of Classification Search
CPC ..... A63F 2009/205; A63F 3/00643; G07F 17/32; G07F 17/3272; G07F 17/3279; G07F 17/3295
USPC ..... 463/11–13
See application file for complete search history.

(56) References Cited

U.S. PATENT DOCUMENTS

| | | | | |
|---|---|---|---|---|
| 6,398,642 | B1 * | 6/2002 | Kim | A63F 3/00643 273/237 |
| 8,360,876 | B2 * | 1/2013 | Imachi | G07F 17/32 463/13 |
| 2005/0014544 | A1 * | 1/2005 | Nara | G07F 17/32 463/13 |
| 2009/0023486 | A1 * | 1/2009 | Nakamura | G07F 17/32 463/11 |
| 2012/0238346 | A1 * | 9/2012 | Hurst | G07F 17/326 463/20 |

* cited by examiner

*Primary Examiner* — Michael A Cuff

(57) ABSTRACT

A method of interaction between a machine and a player or a plurality of players, the method comprising the machine selecting a predetermined plurality of information bearing devices from a predetermined plurality of available information bearing devices as a selected plurality of information bearing devices upon initiation by a player. The machine organizing the selected plurality of information bearing devices for display on a visual display apparatus and the visual display apparatus displaying the selected plurality of information bearing devices as a set of selected information bearing devices in a in first orderly manner representing a first display order.

20 Claims, 9 Drawing Sheets

Fig. 6B
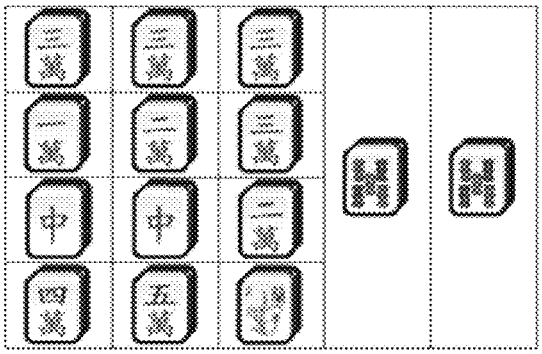
Fig. 6C
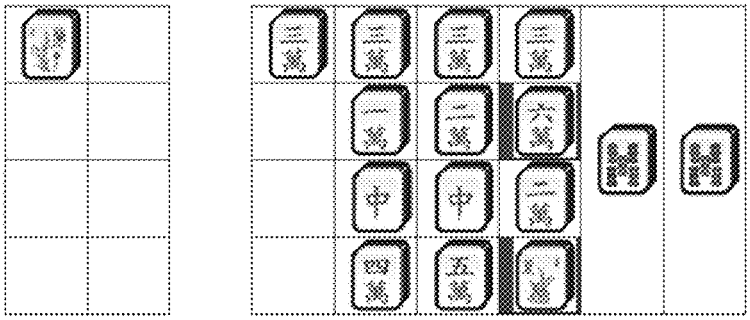
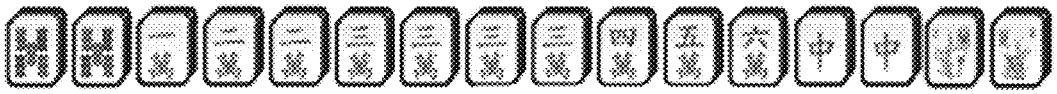
Fig. 6C1
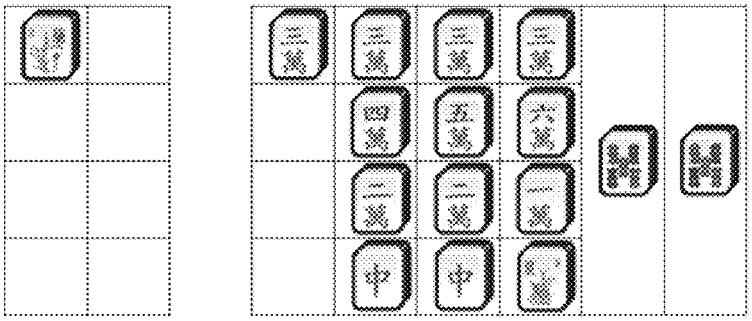
Fig. 6D
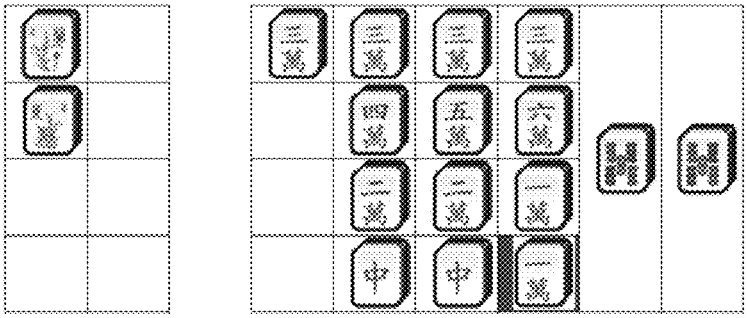
Fig. 6E

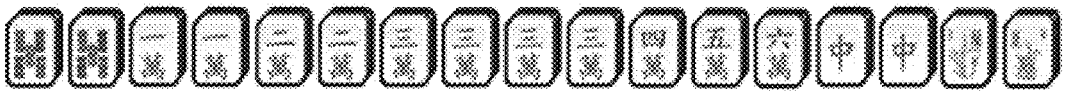
Fig. 6E1
Fig. 6F
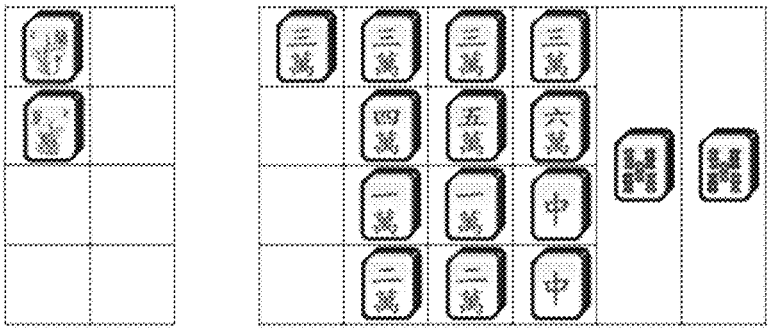
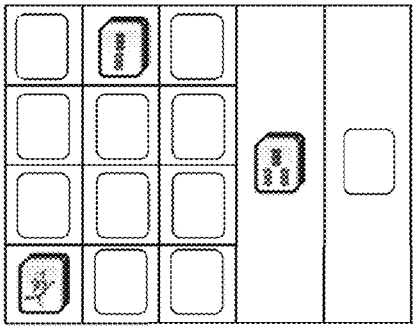
Fig. 7A
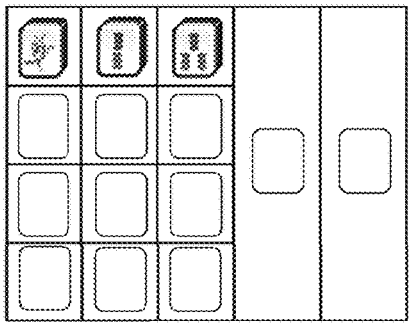
Fig. 7A1
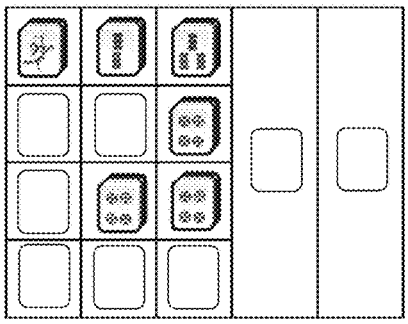
Fig. 7B
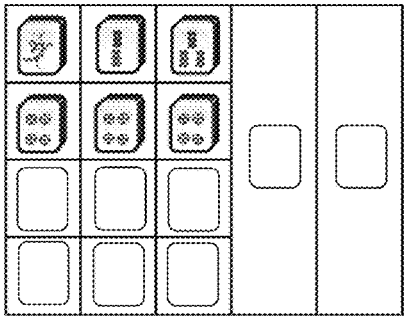
Fig. 7B1

Fig. 7C1

Fig. 7D1

Figure 8A:
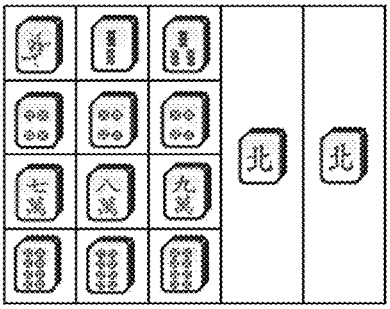
Figure 8A:
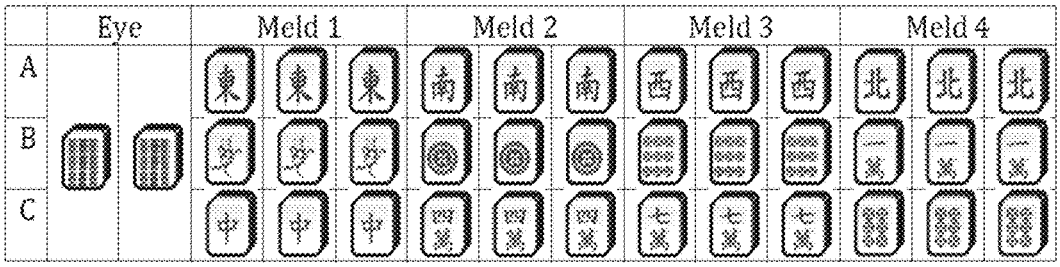

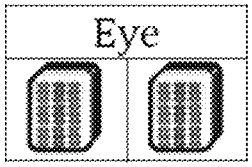
Fig. 8B
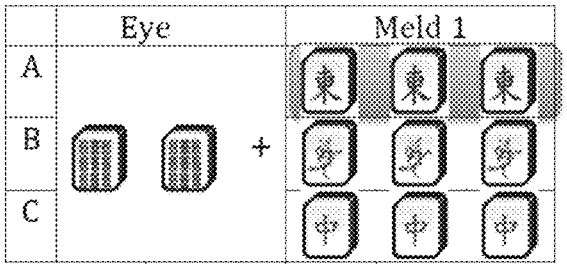
Fig. 8C
Fig. 8D
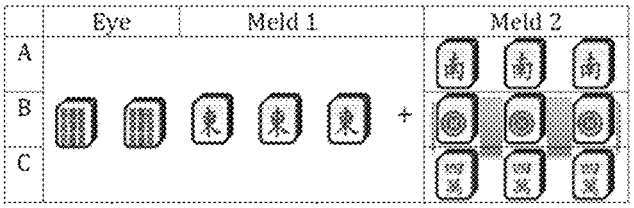
Fig. 8E
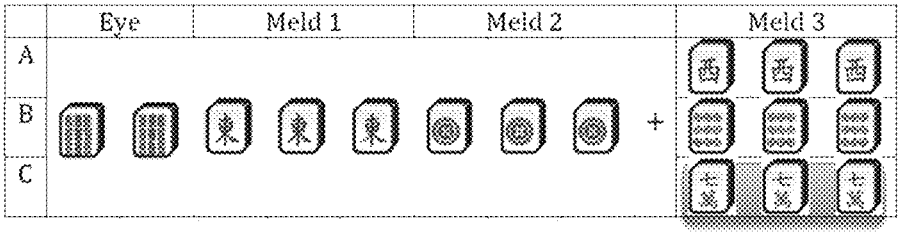
Fig. 8F
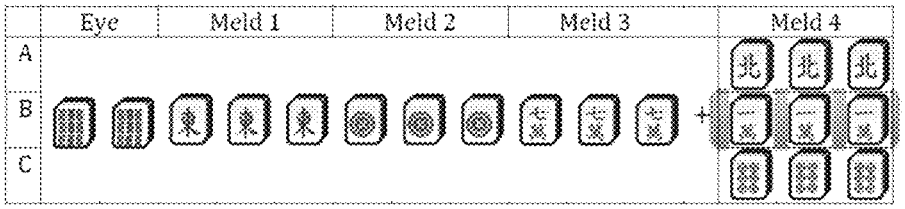
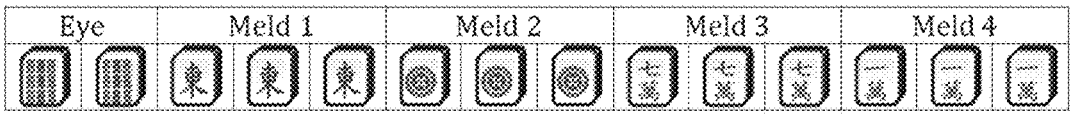
Fig. 8G

METHODS OF USER AND MACHINE INTERACTION AND APPARATUS FOR FACILITATING USER INTERACTION

CROSS REFERENCE TO RELATED APPLICATIONS

The present application claims the benefit of Hong Kong Patent Application No. 16114622.9 filed on Dec. 22, 2016. All the above are hereby incorporated by reference.

FIELD

The present disclosure relates to methods of player and machine interaction and apparatus for facilitating machine and player interaction.

BACKGROUND

Interactive exercises that require mind and motor coordination are beneficial for human health. Card games and oriental domino games such as Mahjong and Pai Gow are examples of mind and motor exercises that confer health benefits for human well-beings. However, many brain and motor exercises require teams or partners which may not be always available.

It would be beneficial to provide means so that brain and motor exercises can be performed through human-machine interactions. Player and machine interactions are known to be useful in providing exercise and training to enhance physical coordination, memory and responsiveness.

DISCLOSURE

A method of interaction involving a machine and a player or a plurality of players and a gaming machine are disclosed.

A method of interaction according to the disclosure involves a machine and a player or a plurality of players comprising: the machine selecting a plurality of information bearing devices from a deck comprising a predetermined plurality of available information bearing devices to form a hand of playing devices upon a player making an initiation request to the machine wherein each playing device is an information bearing device selected from the predetermined plurality of available information bearing devices by the machine; the machine sending the playing devices to an electronic display apparatus representing the player, and displaying the playing devices on a display screen of the electronic display apparatus, wherein the playing devices are distributed in a distribution matrix which is formed on a first display region of the display screen; the machine moving a scoring combination out of an allocated position on the distribution matrix into a second display region of the display screen which is outside the first display region, wherein the scoring combination comprises a playing device or a plurality of playing devices and carries a predetermined score value; the machine maintaining a first counter and incrementing the first counter by a value corresponding to the predetermined score value; and the machine moving the scoring combination back to the allocated position.

In some embodiments, the distribution matrix comprises a plurality of rows of cells and a plurality of columns of cells, and each playing device is to be placed in a single cell. The machine is to distribute the playing devices according to predetermined distribution rules.

In some embodiments, the machine is to select the playing devices according to a drawing sequence, and the machine is to place the playing devices into the cells of the distribution matrix according to the drawing sequence.

In some embodiments, the machine is to reorganize the playing devices after the playing devices are first placed at initial cell locations inside the distribution matrix. The playing devices are reorganized according to the predetermined distribution rules.

In some embodiments, the machine is to shuffle and shift the playing devices from the initial cell locations inside the distribution matrix to destination cell locations inside the distribution matrix by shuffling and/or shifting movements. The shuffling and/or shifting movements are displayed on the display screen.

In some embodiments, the distribution matrix comprises a base matrix and an expanded matrix, and the machine is to perform a supplemental draw of playing devices if the hand comprises a featured device. The machine is to place the playing devices into the expanded matrix following the supplemental draw.

In some embodiments, the expanded matrix comprises a bonus matrix which is detached from the base matrix, and the supplemental draw is required if the hand comprises a bonus device. If the featured device comprises a bonus device, the machine is to move the bonus device from the base matrix to the bonus matrix following a movement path. The movement path is displayed on the display screen and visible to a player and the movement path traverses across the base matrix.

In some embodiments, the first counter is a main counter showing a credit balance of a player, and the machine is to deduct a value corresponding to the value of a bet made by the player from the credit balance upon receipt of the initiation request to form an updated credit balance. The machine is to display the updated credit balance on the first counter on the display screen.

In some embodiments, the machine maintains a second counter, the second counter is to display the predetermined score value.

In some embodiments, the scoring combination forms a scoring event and the machine maintains a second counter which is displayed on the display screen. The second counter shows the predetermined score value.

In some embodiments, the scoring combination forms a scoring event and the scoring event having a nomenclature. The nomenclature is displayed on the second display region of the display screen.

In some embodiments, the machine is to move the scoring combination out of the distribution matrix for making a scoring presentation of the scoring combination in the second display region, and to move the scoring combination back into the allocated position after the scoring presentation. The scoring combination is moved in a bouncy manner.

In some embodiments, when the playing devices can be grouped into a plurality of alternative scoring combinations, the machine is to present all the alternative scoring combinations individually and sequentially on the display screen.

In some embodiments, the machine is to increment the first counter by a value corresponding to the predetermined score value upon presentation of each alternative scoring combination on the display screen.

In some embodiments, the information bearing devices are simulated Mahjong tiles and the playing devices are simulated Mahjong tiles selected from a complete deck of Mahjong.

A gaming machine according to the disclosure comprises a solid-state microprocessor, data storage devices, user interface means and a video display unit. The microprocessor is to execute stored instructions: to select a plurality of information bearing devices from a deck comprising a predetermined plurality of available information bearing devices to form a hand of playing devices upon a player making an initiation request to the machine, wherein each playing device is an information bearing device selected from the predetermined plurality of available information bearing devices by the machine; to send the playing devices to an electronic display apparatus representing the player, and to display the playing devices on a display screen of the electronic display apparatus, wherein the playing devices are distributed in a distribution matrix which is formed on a first display region of the display screen; to move a scoring combination out of an allocated position on the distribution matrix into a second display region of the display screen which is outside the first display region, wherein the scoring combination comprises a playing device or a plurality of playing devices and carries a predetermined score value; to maintain a first counter and to increment the first counter by a value corresponding to the predetermined score value; and to move the scoring combination back to the allocated position.

In some embodiments, the distribution matrix comprises a plurality of rows of cells and a plurality of columns of cells, and each playing device is to be placed in a single cell. The apparatus is to distribute the playing devices according to predetermined distribution rules. The microprocessor is to move the scoring combination out of the distribution matrix for making a scoring presentation of the scoring combination in the second display region, and to move the scoring combination back into the allocated position after the scoring presentation. The scoring combination is moved in a bouncy manner.

In some embodiments, when the playing devices can be grouped into a plurality of alternative scoring combinations, and the machine is to present all the alternative scoring combinations individually and sequentially on the display screen.

In some embodiments, the machine is to increment the first counter by a value corresponding to the predetermined score value upon presentation of each alternative scoring combination on the display screen.

In some embodiments, the machine is to reorganize the playing devices after the playing devices are first placed at initial cell locations inside the distribution matrix.

The playing devices are reorganized according to the predetermined distribution rules. The machine is to shuffle and shift the playing devices from the initial cell locations inside the distribution matrix to destination cell locations inside the distribution matrix by shuffling and/or shifting movements. The shuffling and/or shifting movements are displayed on the display screen.

A method of interaction between a machine and a player or a plurality of players according to the disclosure comprises: the machine selecting a predetermined plurality of information bearing devices from a predetermined plurality of available information bearing devices as a selected plurality of information bearing devices upon initiation by a player, the machine organizing the selected plurality of information bearing devices for display on a visual display apparatus and the visual display apparatus displaying the selected plurality of information bearing devices as a set of selected information bearing devices in a in first orderly manner representing a first display order, where the set of selected information bearing devices comprises a scoring situation, the scoring situation comprising a scoring group or a plurality of scoring groups, and the machine selecting the scoring group or the plurality of scoring groups forming the scoring situation for display, and where the scoring situation is made up of a scoring group or a plurality of scoring groups which in combination consists of a number of information bearing devices less than the total number of information bearing devices in the set of selected information bearing devices, the machine is to generate visually distinguishing representation of the scoring group or the plurality of scoring groups on the visual display apparatus to facilitate selective, salient and/or distinguishable display on the visual display apparatus.

In some embodiments, the machine is to calculate scores according to predetermined rules, and to display a calculated score and/or a cumulative score on the visual display apparatus.

In some embodiments, when there is a plurality of alternative scoring situations that can be formed from the set of selected information bearing devices, and the machine is to sequentially display the alternative scoring situations.

In some embodiments, when the set of selected information bearing devices comprises a plurality of possible alternative scoring groups and the possible alternative scoring groups require one or more information bearing devices in common, and the machine is to display the possible scoring groups in a sequential, salient, distinguishable, and/or human recordable manner on the visual display apparatus.

In some embodiments, when the set of selected information bearing devices comprises a plurality of possible alternative scoring groups and the possible alternative scoring groups require one or more information bearing devices in common, and the machine is to determine individual scores of the alternative scoring groups and to display the individual scores sequentially and/or cumulatively.

In some embodiments, when the set of selected information bearing devices comprises a plurality of possible alternative scoring groups and the possible alternative scoring groups require one or more information bearing devices in common. The machine is to arrange the tiles for display in the first display order corresponding to a first alternative scoring group and to rearrange the tiles for display in a second display order corresponding to a second alternative scoring group.

In some embodiments, a scoring combination comprises a plurality of scoring groups, and each scoring group comprises a predetermined plurality of related information bearing devices, and the machine is to move the information bearing devices belonging to a first scoring group out of the first order and displayed as a first group distinct from remaining information bearing devices.

In some embodiments, the machine is to rearrange the selected plurality of information bearing devices to display on the visual display apparatus in a second order and in a second orderly manner when the set of selected information bearing devices comprises a plurality of possible alternative scoring groups, the second orderly manner representing a second scoring combination different from the first scoring combination.

In some embodiments, each scoring group comprises a predetermined plurality of related information bearing devices, and the machine is to gather information bearing devices belonging to a scoring group and to display the scoring group in a manner distinct from remaining information bearing devices where there are remaining information bearing devices.

In some embodiments, the machine is to move the information bearing devices of a scoring group in a bouncy manner relative to the remaining information bearing devices.

In some embodiments, the machine is to move the scoring group or the plurality of scoring groups out of or away from the first display order to facilitate selective generation of the visually distinguishing representation.

In some embodiments, the machine is to form a selective enlargement of the information bearing devices forming the scoring group or the plurality of scoring groups to distinguish them from the first display order to facilitate selective generation of the visually distinguishing representation.

A machine according to the disclosure comprises a processor, a visual display apparatus and a player interface. The machine is to operate to perform the method according to any preceding claim.

A machine according to the disclosure comprises a processor, a visual display apparatus and a player interface device The processor is to select a predetermined plurality of information bearing devices from a predetermined plurality of available information bearing devices as a selected plurality of information bearing devices upon initiation by a player through the player interface device, the processor is to organize the selected plurality of information bearing devices for display on the visual display apparatus and the visual display apparatus is to display the selected plurality of information bearing devices as a set of selected information bearing devices in a in first orderly manner representing a first display order, where the set of selected information bearing devices comprises a scoring situation, the scoring situation comprising a scoring group or a plurality of scoring groups, and the processor is to select the scoring group or the plurality of scoring groups forming the scoring situation for display, and where the scoring situation is made up of a scoring group or a plurality of scoring groups which in combination consists of a number of information bearing devices less than the total number of information bearing devices in the set of selected information bearing devices, the processor is to is to move the scoring group or the plurality of scoring groups out of or away from the first display order for selective, salient and/or distinguishable display on the visual display apparatus.

FIGURES

Figure 1A:
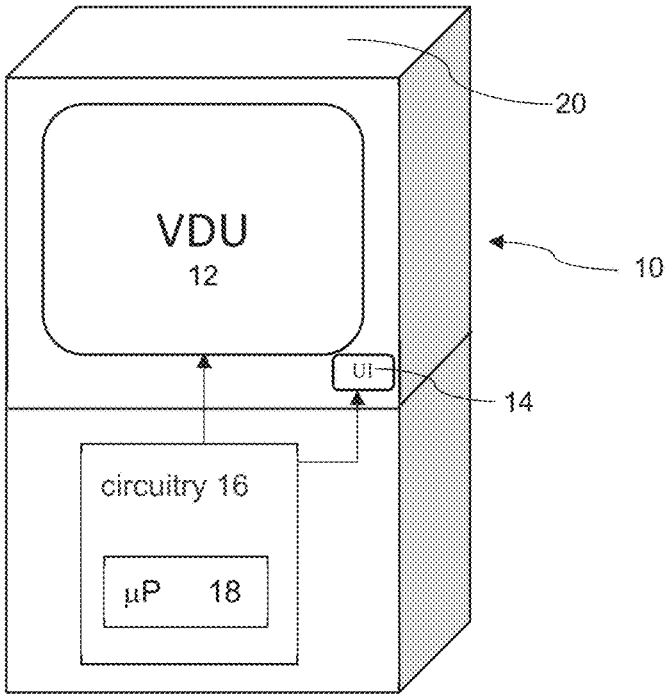
Figure 1B:
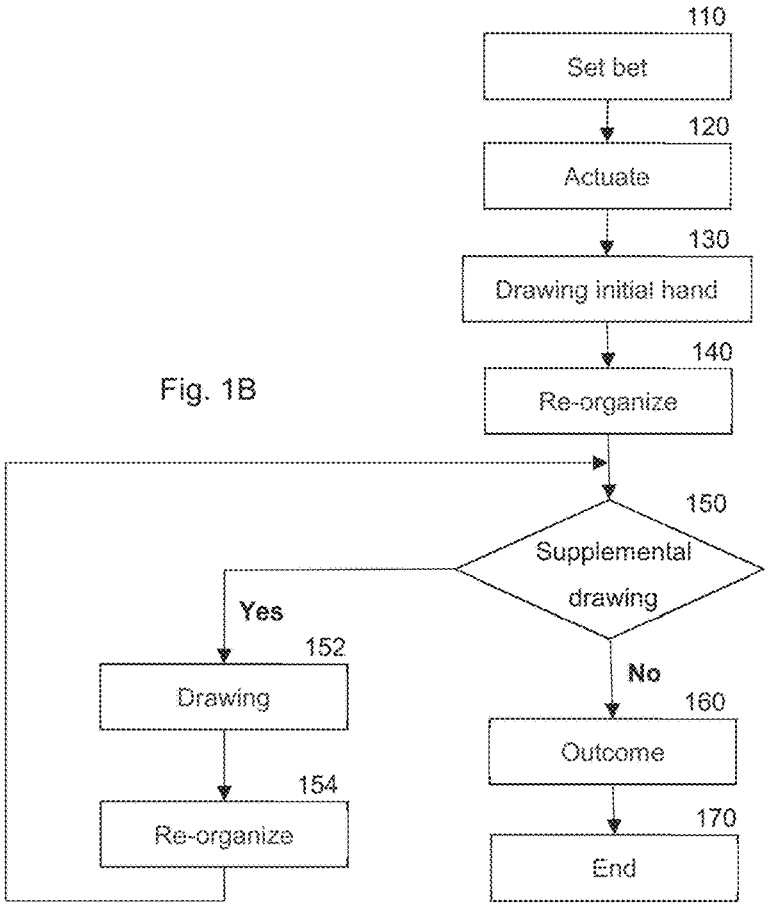
Figure 2A:
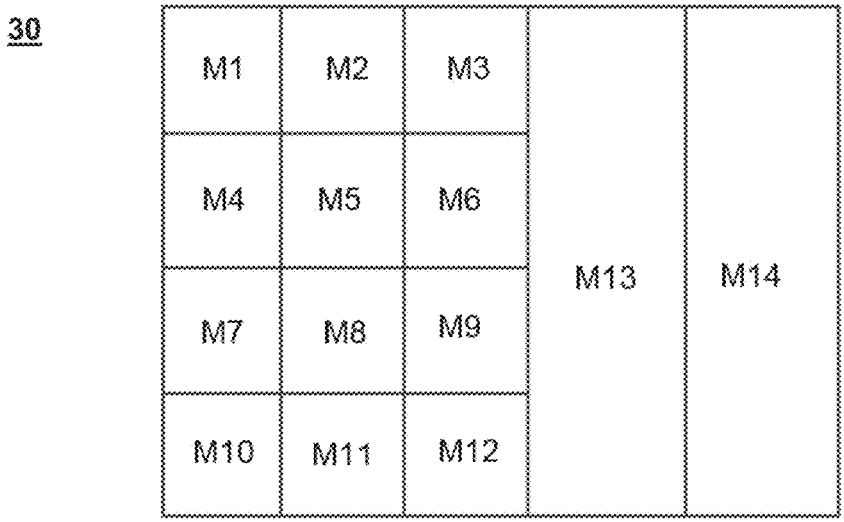
Figure 2B:
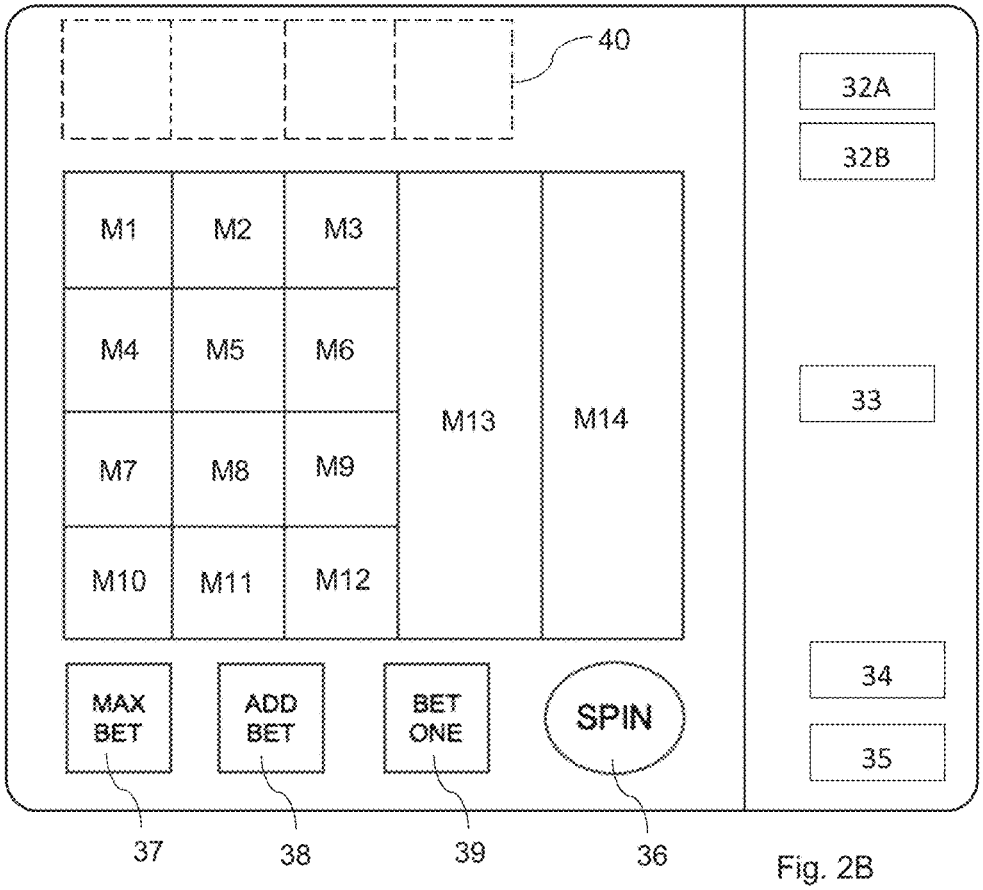
Figure 2C:
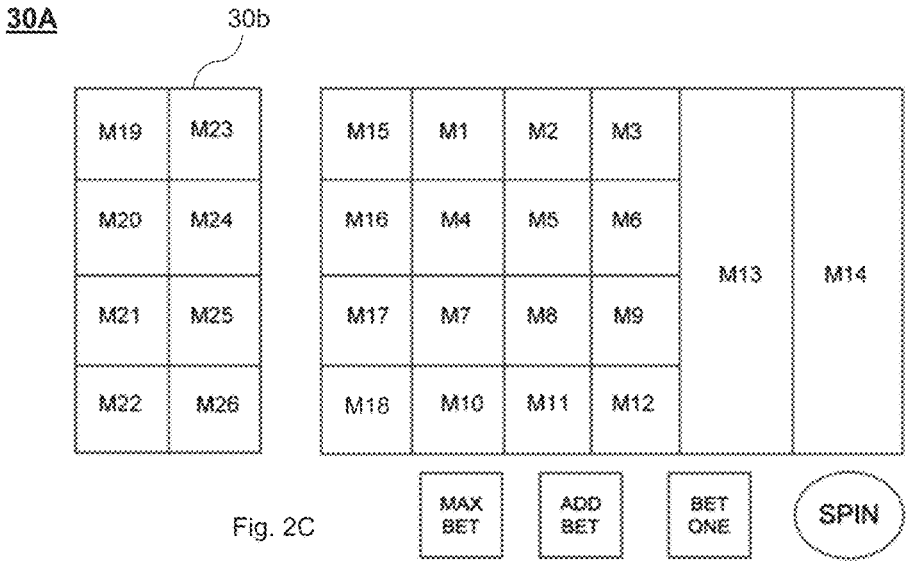
Figure 2D:
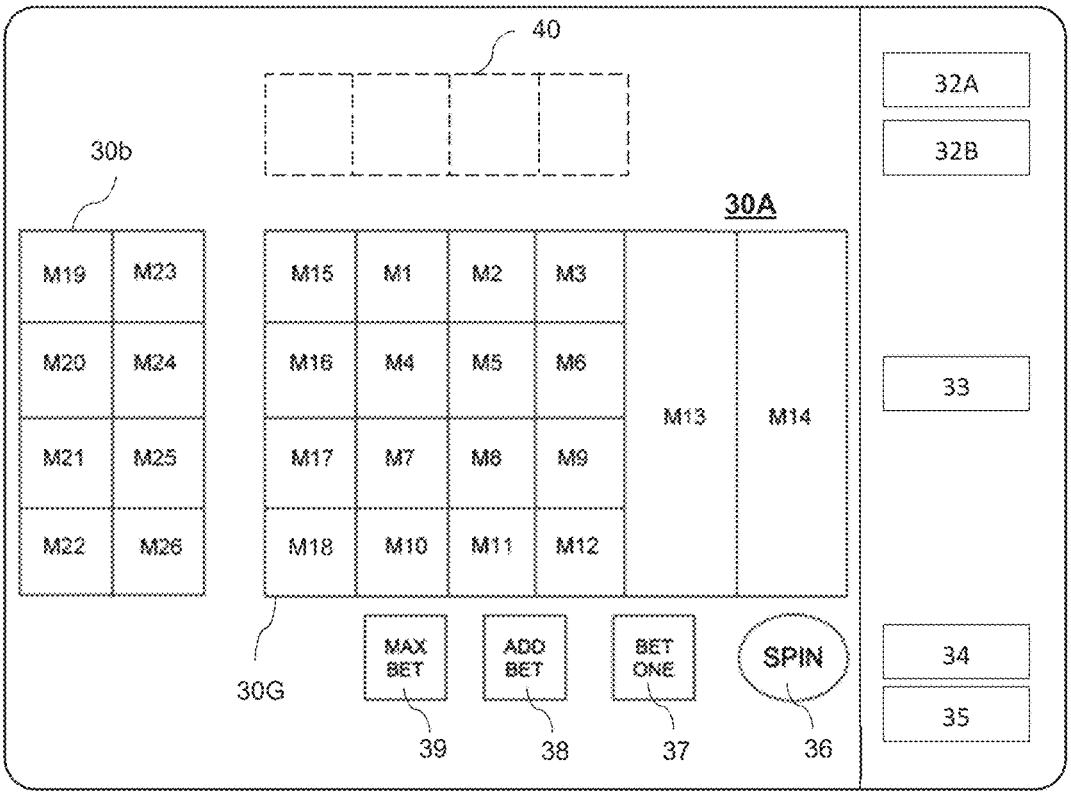
Figure 3A:
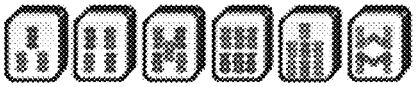
Figure 3B:
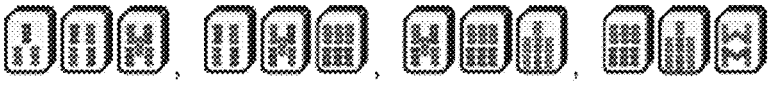
Figure 4A:
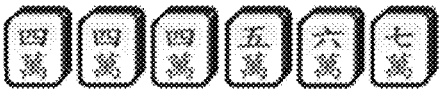
Figure 4B:
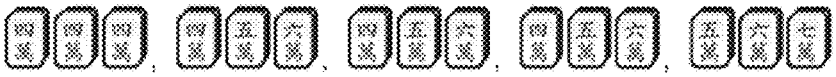
Figure 5A:
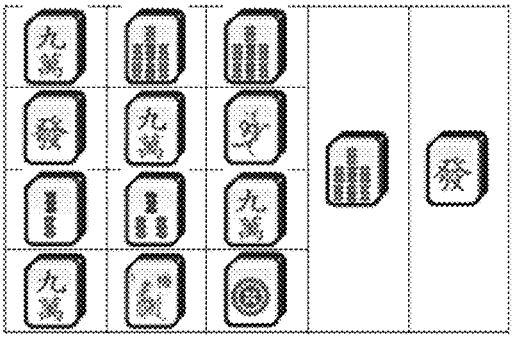
Figure 5A:
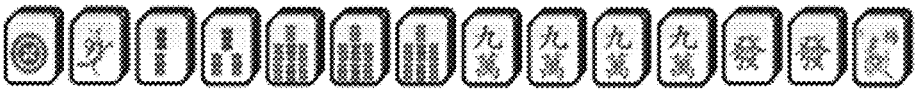
Figure 5B:
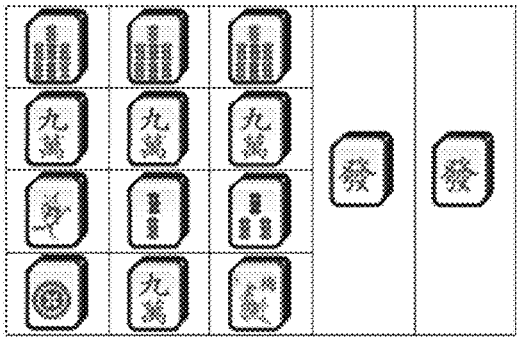
Figure 5C:
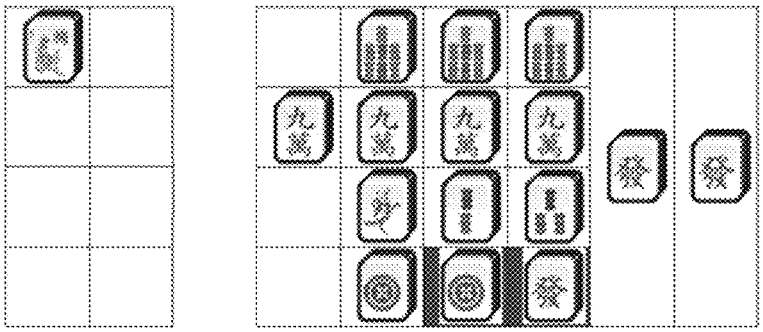
Figure 5C:
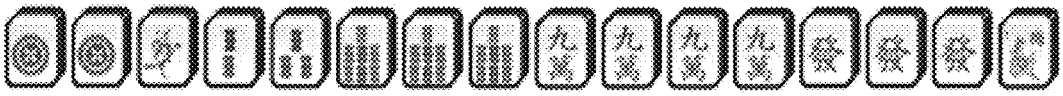
Figure 5C:
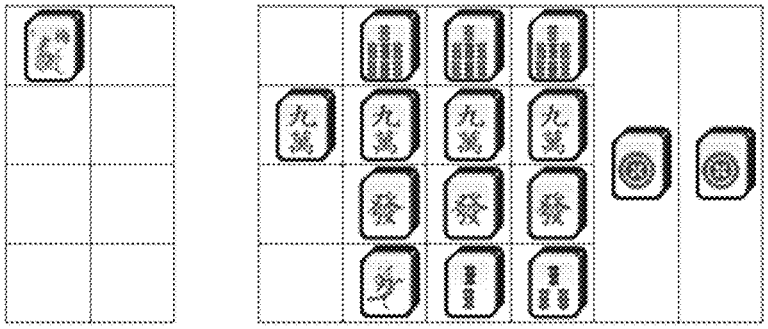
Figure 5D:
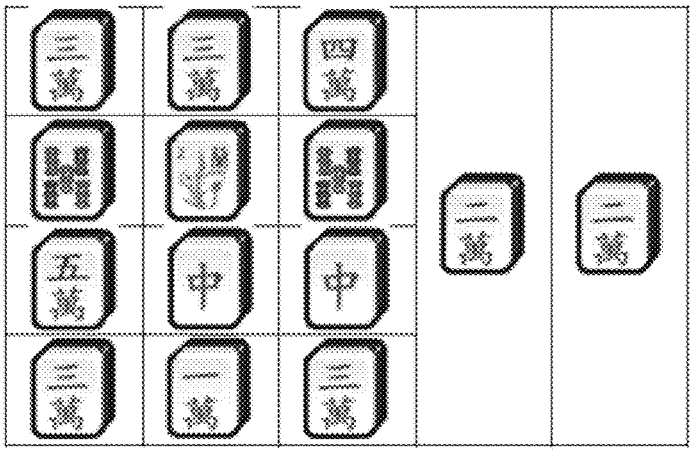
Figure 6A:
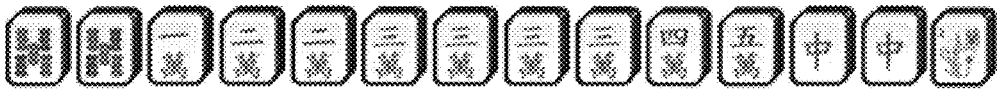

The present disclosure will be described by way of example with reference to example embodiments and the accompanying Figures, in which, FIG. 1A is a block diagram of an example gaming apparatus according to the disclosure, FIG. 1B is a flow chart of an example interactive process according to the present disclosure, FIG. 2A shows an example layout of a tile distribution matrix according to the present disclosure, FIG. 2B shows an example screen layout which is formed on a display screen of an example gaming apparatus and showing the example tile distribution matrix of FIG. 2A, FIG. 2C shows an example expanded tile distribution matrix, FIG. 2D shows an example screen layout which is formed on the display screen of the example gaming apparatus and showing the example expanded tile distribution matrix of FIG. 2C, FIG. 3A shows an example group of tiles of one suit in a hand, FIG. 3B shows possible scoring groups that can be formed from the example group of FIG. 3A, FIG. 4A shows another example group of tiles of one suit in a hand, FIG. 4B shows possible scoring groups that can be formed from the example group of FIG. 4A, FIG. 5A shows an initial hand of tiles distributed in an order matrix, FIGS. 5B, 5C and 5D show ordered arrangement of tiles after initial draw and supplemental draws, FIGS. 5A1 and 5C1 show a listing of tiles after the initial draw and final supplemental draw of the process beginning from FIG. 5A, FIG. 6A shows another initial hand of tiles distributed in an order matrix, FIGS. 6B, 6C, 6D, 6E and 6F show ordered arrangement of tiles after initial draw and supplemental draws, FIGS. 6A1, 6C1 and 6E1 show a listing of tiles after the initial draw and final supplemental draw of the process beginning from FIG. 6A, FIGS. 7A, 7A1, 7B, 7B1, 7C, 7C1, 7D, 7D1 and 7E are representations of a process according to an optional feature, and FIGS. 8A, 8B, 8C, 8D, 8E, 8F and 8G are representations of a process according to an optional feature.

DESCRIPTION

An example interactive method is described with reference to the oriental game of Mahjong ("MJ"). Mahjong is a tile-based game originated in China and is commonly played by four players. Mahjong is a game of skill and strategy which requires a calculation of probability and involves a degree of chance and the making of decisions. Traditionally, the Mahjong players sit on four sides of a square table, gets an initial hand of tiles, and then draw and discard tiles in turn while maintaining the same number of tiles in a core hand until someone complete a winning hand. A winning hand comprises an example plurality of three or four melds and a pair. A meld of Mahjong tiles is also referred to as a set and a pair is also known as an eye. A typical Mahjong game is played with a set of 144 tiles and a player gets an initial hand consisting of a number of tiles when the game begins. In a typical game, a player gets 14 or 17 tiles in the initial hand according to the variation of the game. After receiving a core hand, a player can get an extra tile when a featured tile is drawn or a featured set is form. An example of a featured set is four of a kind. A featured tile is either a bonus tile or a tile which forms part of a Gong.

A set of Mahjong comprises tiles of numbered suits or Suited tiles, Honor tiles, and Bonus tiles.

There are three different types of numbered suits or Suited Tiles, namely, Dots, Bamboos and Characters. Each numbered suit comprises tiles which are numbered one to nine, and there are four identical tiles of the same suit bearing the same number.

The Honors tiles are non-numbered tiles and consist of Winds tiles and Dragons tiles. The winds tiles comprise four different types of winds, namely, East, South, West, and North. There are four identical tiles of the same wind. The Dragons tiles comprise three different types of dragons, namely, Red (also known as Chung), Green (also known as Fat) and White (also known as Pak).

A bonus tile can be a Flowers tile or a Seasons tile, but a player is entitled to a bonus only if the player is in a right position with respect to other players in the conventional game.

The Flowers tiles comprise one Plum tile (numbered 1), one Orchid tile (numbered 2), one Chrysanthemum tile (numbered 3), and one Bamboo tile (numbered 4).

The Seasons tiles comprise one Spring tile (numbered 1), one Summer tile (numbered 2), one Autumn tile (numbered 3), and one Winter tile (numbered 4).

The following MJ terminology is used herein.

Hand: a set that consists of 14 or 17 tiles is called a hand.

Eye: a pair of 2 identical pieces.

Meld: a specific set of 3 pieces.

Pong: a meld of 3 identical pieces.

Chow: a meld of 3 Suit tiles in sequence.

Kong: a specific pattern of 4 identical pieces.

Winning hand: consists of 4 melds (a specific pattern of 3 pieces) and eyes (a pair of identical tiles). Exceptions to this rule are special featured hands.

Mahjong Deck: a set of Mahjong tiles consisting of 144 Mahjong tiles.

In example methods, a player upon making a valuable contribution, for example, by payment of a wager or a valuable consideration in electronic or physical form, and upon making of a request to a banker to initiate a process will be distributed a hand of tiles. The tiles are simulated tiles which are to be displayed on a display screen visible to the player. The simulated tiles are distributed into cells of a matrix which comprises a plurality of rows and a plurality of columns.

In example methods, the player will win and earn credits or scores if the player is distributed with a winning hand on initial distribution, and the credit or scores are calculated according to a set of predetermined award rates according to the total scores. Where the initially distributed hand does not form a winning hand, for example, a winning hand according to conventional Mahjong rules, the player will still gain credits or scores if the initial hand comprises a scoring group or a plurality of scoring groups. Each scoring group comprises a credit earning combination.

Table 1 below sets out some example of credit earning tiles, combinations or groups of tiles.

TABLE 1

| Group Name | Description | Score grade |
|---|---|---|
| 1) Chow | A group of three tiles of the same suit in number sequence | A |
| 2) Pong | A group of three identical tiles | B |
| 3) Kong | A group of four identical tiles | C |
| 4) Flowers | A bonus tile | D |

A Chow type scoring group comprises three tiles of the same suit in numbered sequence. A player will earn a grade A credit or a grade A reward for each Chow.

A Pong type scoring group comprises three identical tiles, and the tiles can be numbered tiles, wind tiles or dragon tiles. A player will earn a grade B credit or a grade B reward for each Pong.

A Kong type scoring group (or 'group' in short) comprises four identical tiles, and the tiles can be numbered tiles, wind tiles or dragon tiles. A player will earn a grade C credit or a grade C reward for each Kong.

A player will earn a grade D credit or a grade D reward for each flower. Where there is a Flower in a hand, the featured tile is moved out of the matrix and a player is entitled to draw an additional tile from a pool of undrawn tiles available.

Where there is a Kong type group, a player is entitled to draw an additional tile from a pool of undrawn tiles available.

In an example method, each of the grade A, B and C scores entitles a player an award of 0.5 bet unit and a grade D entitles a player an award of 0.25 bet unit. The awards may be in addition to the award of a winning hand, or may be awarded only in absence of a winning hand.

An example winning hand may comprises an example plurality of four scoring groups and a pair of identical tiles forming an eye. For example, a winning hand may comprise:

4 Chow type melds plus an eye.

4 Pong type melds plus an eye.

Chow type melds and Pong type melds forming four melds plus an eye.

Other winning combinations.

Each winning hand has an associated score and the associated score is dependent on the scoring group combination.

For example, a winning hand of all Pong type groups or all Chow type groups plus a pair of eyes has a higher score than a winning hand comprising a mixture of Pong type groups and Chow type groups plus an eye. Each of the flower tiles or season tiles may entitle a player to a bonus score.

Where the four groups and an eye which cooperate to form a winning hand are tiles of the same type, (that is, all Dots, all Bamboos, all Characters, all winds, all dragons), there will be a bonus score.

In example operations, a machine is to execute stored instructions to interact with a player to perform a novel interactive method herein. An example machine for performing the interactive method comprises electronic circuitry including a solid-state microprocessor (μP), a data storage device comprising volatile and non-volatile memories, and a player interface (UI). The player interface may include a video display unit (VDU) having a display screen and actuation means such as a mouse, a keyboard, a joystick or their combination. In some embodiments, the machine may be configured as an EGM ("Electronic Gaming Machine"), for example, a slot-machine type of apparatus. When the machine is of an EGM 10, as depicted in FIG. 1A, the VDU 12, the player interface 14, and the electronic circuitry 16 including a microprocessor 18 are installed inside a rigid main housing 20, and the VDU is optionally located at eye-level of a player. The example interactive method may be stored in the form of an application software. The application software may be pre-installed, or may be downloadable locally or remotely, for example, through telecommunications means such as the Internet or WiFi. The application software may be installed and executable on a computer, including notebook computer, tablet computers and personal computers, or on a smart phone to enable the computer or the smart phone to operate as a machine herein, which is a gaming machine.

During gaming operations, the microprocessor is to execute stored instructions to draw a hand of tiles for distribution to a player and then to distribute the drawn tiles to a player. The tiles are drawn according to a predetermined scheme of selection. The scheme of selection is a scheme which will result in a near par long-term RTP ("return-to-player") so that a player will enjoy the process with minimum expenditure while having a probability of achieving a short-term gain. The selection and drawing of tiles are designed to appear random to a player with minimal repetition. For example, the tiles may be drawn with aid or assistance of a random number generator (RNG) or a pseudo-random number generator. In some embodiments, the drawing of tiles is according to a predetermined scheme. The predetermined scheme may be devised so that a plurality of preset groups of combination of tiles is to be distributed to a player during a prescribed gaming cycle comprising a predetermined plurality of plays to control RTP within the gaming cycle. A play herein involves a single initial draw and distribution of tiles to a player.

The tiles to be distributed are simulated tiles, and the simulated tiles are to appear on the VDU as graphical representations. Each simulated tile is shown as a graphical representation on the VDU and has an appearance resembling the appearance of a real-life Mahjong tile.

To initiate the interactive gaming process, a player is to interact with the gaming machine and operate an actuation means of the player interface. When the player operates the actuation means to start a gaming process, the actuation means will send an actuation signal to the microprocessor. Upon detection of the actuation signal, the micro-processor will determine whether the player has a valid playing status, and will start the gaming process if the player has a valid playing status. In general, the player has a valid playing status if the player has made a valid contribution to play. A valid contribution may be money or money's worth and the contribution is often referred to as a bet or a wager.

At beginning of the process, the microprocessor will draw a hand of tiles from a full set of tiles and then distribute the drawn tiles to the player. The processor will then distribute the drawn plurality of tiles into a corresponding plurality cells of a tile distribution matrix. The tile distribution matrix and the cells are preset according to a predetermined screen layout and are presented on the display screen. Optionally, the boundary or border outlines of the tile distribution matrix and the cells are not visible on the display screen, for example, concealed by a dark background on the display screen of the VDU.

An example tile distribution matrix 30 comprises a base matrix, which is also referred to herein as a main matrix, as depicted in FIG. 2A. The base matrix is a base matrix comprising a plurality of rows of cells and a plurality of columns of cells for housing the initial hand of tiles distributed by the machine. Referring to FIG. 2A, the example tile distribution matrix comprises an example plurality of 4 rows of cells and an example of 3 columns of cells forming a center matrix having 12 cells, and a lateral matrix comprising a side row comprising 2 cells, making a total of an example plurality of 14 cells available for housing a corresponding plurality of 14 tiles of the example hand of tiles. The cells of the tile distribution matrix are sequentially numbered. In the example of FIG. 2A, the cells are sequentially numbered such that the cells in the first row, which is on the top row of the center matrix, are numbered M1, M2, M3 from left to right; the cells in the second row, which is the row immediately below the top row of the center matrix, are numbered M4, M5, M6 from left to right; the cells in the third row, which is the row immediately below the second row of the center matrix, are numbered M7, M8, M9 from left to right; the cells in the fourth row, which is the row immediately below the third row of the center matrix, are numbered M10, M11, M12 from left to right; and the cells in the side row, which is on the right side of the center matrix and located between the second and third rows of the center matrix, are numbered M13, M14 from left to right.

Where an initial hand has example plurality of 17 tiles according to a game variant, the center matrix may be set to have an example plurality of five row each having three cells, and the side row may be aligned with the third row.

In addition to the tile distribution matrix, narrative captions may be formed on the display screen to provide performance information to the player. For example, narrative captions may be placed on the left or right side of the matrix, as depicted in FIG. 2B. As an example, narrative captions showing score types 32A, 32B, credit gained 33 in the instant play, credit balance 34, and value of wager 35 are shown on the right side of the display screen, as depicted in FIG. 2B.

In this example, an actuation means is formed as an actuation icon on the display screen. The example actuation icon is marked "SPIN" 36. When a player drags a cursor to the actuation icon, the indicia of the cursor will change from the shape of an arrow to a hand-shaped pointer device signifying ready actuation of process upon clicking of the mouse. Additional and/or optional control commands may be devised. For example, additional control icons may be devised below the main tile distribution matrix. The example control icons depicted in FIG. 2B comprise a "MAX BET" icon 37, an "ADD BET" icon 38 and a "BET ONE" icon 39. Actuation of the "MAX BET" icon enable a player to set the wager to the upper bound. Actuation of the "ADD BET" icon enable a player to increase the wager by a predetermined increment unit. Actuation of the "BET ONE" icon enable a player to increase the wager by a single wager unit.

Referring to the flow diagram of FIG. 1B, after the wager value has been set and paid by the player at 110, the player will proceed to the next step of actuating a tile drawing process at 120, for example, by clicking the "SPIN" icon to actuate the process and to send an actuation signal to the microprocessor.

Upon detection of an actuation signal, the machine will operate to select and draw a predetermined plurality of tiles, and the predetermined plurality of tiles corresponds to an initial hand of tiles. In some embodiments such as the present, the machine is to operate to distribute the drawn tiles sequentially into the sequentially numbered cells according to the sequence of drawing at 130. Next, the machine will proceed to re-organize the distributed tiles into a distribution manner at 140 so that the tiles are organized in a manner which is more player friendly, for example, more easily perceivable by a human player. If the initial hand comprises a featured tile or featured tiles, the microprocessor will perform a supplementary draw to make up for the featured tile or featured tiles at 150. If the supplementary draw results in another featured tile or other featured tiles, a further supplementary draw will be performed at 152 and reorganization at 154, until no more featured tile is drawn. A feature tile means a Seasons tile, a Flowers tile, or a tile which is to form part of a Gong. After tiles drawing and reorganization has completed, the processor will proceed to a pay-out process at 160 and the play will end at 170 after the pay-out process.

Where a hand comprises a featured tile, an expanded tile distribution matrix 30A will be used to accommodate the drawn tiles. For example, drawn tiles comprising drawn featured tiles and non-featured tiles may be accommodated in an example expanded tile distribution matrix as depicted in FIG. 2C for orderly display. The example expanded tile distribution matrix 30A comprises a bonus tile matrix 30*b*, a Gong matrix 30G and the base matrix 30. The bonus tile matrix 30*b* and the Gong matrix 30G combine to form a supplemental matrix, and the supplemental matrix combined with the base matrix 30 to form the expanded tile distribution 30A. The Gong matrix 30G comprises four rows, and each row has a single cell to form a single column of cells. The Gong matrix is prepended to the left side of the base matrix 30 to form an expanded base matrix. The example expanded base matrix comprises four rows each comprising four cells to form a four by four base matrix. In embodiments where an initial hand has 17 tiles, the expanded base matrix will have five rows each comprising four cells to form a five by four base matrix without loss of generality. The expanded base matrix in combination with the lateral matrix forms an expanded base matrix.

The bonus tile matrix 30*b* comprises an example plurality of four rows each of an example plurality of two cells to accommodate an example plurality of eight bonus tiles in a standard Mahjong set. The bonus tile matrix may be detached from the expanded base matrix and may be parallelly displaced from the expanded base matrix by a width comparable to the width of a column for enhanced visibility.

In this example, the supplemental matrix is on left side of the base matrix 30. In other embodiments, the supplemental matrix is on right side of the base matrix 30 to meet dexterity requirements of a player. In some embodiments, the apparatus may include a control means to allow a player to set dexterity settings so that the supplemental matrix is on a preferred side. In some embodiments, the bonus tile matrix may be horizontally disposed (compared to the vertical disposition in FIG. 2C), and may be above or below the base matrix. For example, the bonus tile matrix may comprise an example plurality of two rows each of an example plurality of four cells to accommodate an example plurality of eight bonus tiles in a standard Mahjong set. The bonus tile matrix may be detached from the expanded base matrix and may be parallelly displaced from the expanded base matrix by a width comparable to the width of a row for enhanced visibility.

In the example herein, a column is vertically disposed and a row is orthogonal to a column and is horizontally disposed. In some embodiments, a row is vertically disposed and a column is orthogonal to a column and is horizontally disposed without loss of generality.

In example embodiments, the machine is to re-organize the drawn tiles according to a set of distribution rules after the drawn tiles have been initially distributed, for example, initially distributed according to drawing sequence, to assist a player to more easily visualize and perceive the quality of the drawn tiles. The quality of drawn tiles relates to the total apparent score of the drawn tiles, as an example. The distribution rules are to facilitate easier perception by a human player to facilitate mind and eye exercises and are not strict or mandatory rules to follow. For example, no re-organization or re-distribution may be required for an advanced level player, since the player may be skillful enough to visualize the quality of the drawn tiles without re-ordering.

In example interactive processes, the machine is to operate to organize the drawn tiles so that Bonus tiles are placed inside the bonus tile matrix which is outside the base matrix or the expanded base matrix, and non-Bonus tiles are inside in the base matrix or the expanded base matrix according to example distribution rules set out below.

Example Distribution Rules

In a sequential order and in descending order of priority for cells M1 to M14, or M1 to M18: Suited tiles and then Honors tiles. For Suited Tiles, the sequence in descending order of priority is: Dots, Bamboos and Characters. For Honors Tiles, the sequence in descending order of priority is: Winds and Dragons. For Winds Tiles, the sequence in descending order of priority is: East, South, West and North. For Dragons Tiles, the sequence in descending order of priority is: Red, Green and White.

For the bonus tiles in the bonus tile matrix, the tiles are organized in the following example manner:

In a sequential order and in descending order of priority: Seasons and Flowers. For Seasons, the order or priority in sequence is: Spring, Summer, Autumn and Winter; and for Flowers, the order or priority in sequence for Flowers tiles is: Plum tile (numbered 1), Orchid tile (numbered 2), Chrysanthemum tile (numbered 3), and Bamboo tile (numbered 4).

Among the Suited tiles, the sequence in descending order of priority is: three or four tiles of the kind, and then tiles in number sequence.

Among the Honor tiles: three or four tiles of the kind.

For Suited tiles and/or Honor tiles, a pair of identical tiles which does not form a Pong or a Gong, or which does not have two immediately preceding or succeeding sequentially numbered tiles of the same suit, will be placed in the lateral matrix or the side row to appear as a pair of eyes.

For Suited tiles and/or the Honor tiles of a lower priority, a pair of identical tiles will be placed adjacent to each other, preferably in the same row.

Where there is a Pong or a Gong, the Pong or Gong tiles are to be placed in the same row for easier player identification. For a Gong, the Gong tiles will be placed in a row in the expanded base matrix. Where there are numbered suited tiles preceding or succeeding a pair, a Pong or a Gong, the tiles are to be group together, although a Pong or a Gong would occupy a single row for ease of perception by a human player.

The distribution rules are to facilitate easier perception by a human player to facilitate mind and eye exercises and are not strict rules to follow.

On initial drawing of tiles by the machine, the drawn tiles are placed sequentially in the tile distribution matrix according to the sequence of drawing, that is, the sequence that the tiles are drawn from the deck. The initial positions of the drawn tiles in the tile distribution matrix are displayed on the display screen. The machine will next proceed to re-distribute the tiles according to preset distribution rules to facilitate enhanced perception by a player. On re-distributing the tiles from the initial positions to destination positions, some or all of the tiles are shuffled or shifted around. The shuffling and shifting of the tiles from initial positions to destination positions is visible and transparent to the player and is shown on the display screen. The player can move eyes to follow the movements of the tiles.

In example embodiments, and for example, where the initial drawn hand of tiles includes a bonus tile, and the bonus tile is placed initially in an initial cell in the base matrix according to its drawn sequence, the bonus tile will be shifted from its initial position to a destination position in the bonus tile matrix during the shuffling and shifting process. During the shuffling and shifting, the bonus tile is moved from its initial position and travels across the base matrix until reaching the bonus tile matrix. In addition, the initial drawn tiles which are non-bonus tiles are shifted and shuffled from their initial positions to their destination positions within the base matrix. Where the initial drawn tiles comprise a Gong, the base matrix will expand into the expanded base matrix and the Gong will be placed in a row in the expanded base matrix. The shuffling and shifting take place on the display screen and a player can visualize and view the movements to understand the process.

After the bonus tile has been moved to the bonus tile matrix and the optional initial organization has completed, the machine will progress to perform a supplementary draw to replenish the featured tiles (bonus tiles and a tile forming a Gong) which are moved out of the base matrix, for example into the bonus tiles matrix and/or the expanded base matrix. The process will repeat until no new featured tile is drawn and the machine will proceed to the payout process.

In this example, the tiles are shuffled around the tile distribution matrix to perform optional ordering of the tile to facilitate easier perception of presence of possible available scoring events by a human player.

After initial drawing, supplementary drawing and optional re-organization of the drawn tiles have been completed, the machine will proceed to 160 to payout if payout is available.

After tile organization has been performed and completed, the machine will proceed to operate to work on possible pay-outs. In example operations, the pay-out is performed in a step-by-step manner to promote mind and eye coordination of a human player.

To perform the payout process, the microprocessor will examine and evaluate the drawn tiles to identify scoring events. Scoring events can be set according to predetermined rules according to variants of the process to achieve specific target or objectives, for example, a desired balance between RTP, profitability and player incentive.

In example processes such as the present, each one of "Chow", "Kong" and "Gong" is a scoring event and each scoring event carries a predetermined scoring rate as set out in Table 1. A bonus tile when matched with the playing position of the player is also a scoring event and carries a predetermined scoring rate as set out in Table 1. For example, the Plum tile (numbered 1) is a scoring event for a player in the east position, but a non-scoring event for a player in other positions, such as South, West, or North. The Orchid tile (numbered 2) is a scoring event for a player in the south position, etc. In typical variations, the East position is where a Mahjong game begins and is a first portion. The South, West, and North positions are respectively the second, third and fourth positions. Similarly, the Spring tile (numbered 1), the Summer tile (numbered 2), the Autumn tile (numbered 3) and the Winter tile (numbered 4) are bonus tiles constituting a scoring events for players in the first, second, third and fourth positions, respectively. In some embodiments, a new scoring event, a plurality of new scoring events, whether as replacement scoring events and/or additional scoring events can be defined without loss of generality.

In some embodiments, the machine is to operate to identify as many scoring events from the finally drawn tiles as possible to provoke mind working of a player. In some example embodiments, a tile or tiles may be used repeatedly or more than once to form scoring events to promote mind working of a player.

The machine will operate to increment the total scores achieved by the player and credit the player's account upon identification of each scoring event. To facilitate easier identification of scoring events, the machine optionally organizes the drawn tiles according to pre-determined sequencing or distribution rules to facilitate manageable recognition or perception by a player.

In example pay-out processes, the machine will identify possible scoring events and then to present the identified scoring events to a player individually and in a sequential manner on the display screen. So that the presentation of scoring events can be clearly identified and visible by a human player, each of the scoring events is presented individually and saliently. The presentation of individual scoring events on the display screen provide means to assist a player to verify the players own prediction of scoring events and scoring results.

In example embodiments, a display window 40 defining a scoring worksheet region is formed in the display region of the display screen, for example, on a background portion of the display screen and separate from the tile distribution matrix, as depicted in FIGS. 2B and 2D. The presentation of a scoring event in a separate display window provides enhanced visibility and transparency of credit calculation to a player.

In example embodiments, a tile or a group of tiles which forms a scoring event is moved out of the tile distribution matrix and placed temporarily in the scoring worksheet region for display to a player and for easier identification by the player. The tile or the group of tiles which forms a scoring event is referred to as a scoring combination herein. At the time of presentation of a scoring event at the scoring worksheet region, the scoring event type, number of occurrence of a specific scoring event type, the scoring value or credit gained by the scoring event and the cumulative credits are displayed on the VDU, for example, at the display regions 32A, 32B, 33, 34 and 35. The presentation of a scoring event at the scoring worksheet region is referred to as a scoring presentation herein and the scoring worksheet region is also referred to as a score presentation window.

After a scoring combination has been presented at the scoring worksheet region, the tile or the group of tiles is moved back into the tile distribution matrix. On moving from the tile distribution matrix to the score presentation window, the scoring combination may need to traverse a row or rows of tiles of the tile distribution matrix. On moving from the score presentation window back to the tile distribution matrix, the scoring combination would need to traverse the same row or rows of tiles of the tile distribution matrix. The reciprocal movements to and from the score presentation window creates a bouncing type of movement and this bouncy motion of the tiles promotes eye and mind exercise of a player, resulting in player and machine interaction. To mitigate blocking of a tile or tiles which are on or along the movement paths, the movement of a moving tile to form a scoring presentation is devised such that the moving tile appears to move behind an intervening tile which is on the movement paths. When a tile is moved out of its position, its position on the tile distribution matrix is temporarily left blank so that a player can follow interactive which tile or tiles are being moved to form a scoring event. The scoring event forming tiles may move as a group together or individually. More than one tile may be moved out of a scoring group to give room for forming a next scoring group. For example, where a plurality of more than three sequentially numbered tiles is available for multiple scoring combinations, a first scoring group of three sequentially numbered tiles may move simultaneously from the main matrix to the score presentation window 40 for flash presentation. After an initial flash presentation has been made with the first scoring group, one of the tiles to be replaced will be moved back to its original position in the main matrix and a replacing tile will be moved to the score presentation window 40 to replace the returned tile to prepare for flash presentation of a scoring group. The process will continue until all scoring groups have been displayed. Where the scoring forming tiles comprise a Pong meld, say 4, 4, 4, plus a plurality of tiles, say 3, 5 and 6 of the same suit, which can form at least one chow when in combination with one of the Pong tiles, the Pong group may be moved to the score presentation window 40 together to form a first presentation group. Next, two of the Pong tiles (4) are returned to the main matrix and two replacing tiles, say, 3 and 5 are moved from the main matrix to the score presentation window 40 to form a Chow group 3, 4, 5 for display on the score presentation window 40. After that, the tile 3 will be moved back into the main matrix and replaced by the tile 6 to form another scoring group and scoring event. In other embodiments, a Chow group, say for example, 3,4,5 may be formed first and the other scoring combinations may be formed subsequently and/or sequentially without loss of generality.

The scoring presentations will take place individually and sequentially until all scoring presentations have been completed. Of course, where there is no scoring event, there is no scoring presentation and no credit gained, and the instant game comes to end. At the end of an instant game, a player may start another game by triggering the SPIN icon again to re-start the process upon paying another wager.

In example games, the processor is to arrange and distribute the initially drawn tiles into the 14 cells to form a first display order. If the set of 14 initially drawn tiles comprises a special tile or special tiles such a 'season', a 'flower', or a bonus tile, the player will need to draw an additional or supplemental tile. If the set of 14 initially drawn tiles comprises a 'Kong' type group, the player will at its discretion decide whether to declare 'Kong' and draw an additional or supplemental tile. If the player decides not to declare Kong, the player will be entitled to declare later on or not to declare 'Kong' at all. In this example, a "Kong" will be automatically formed by the machine upon detection.

In an example display order, the order matrix is arranged into five tile groups. Referring to FIG. 2B, the five tile groups comprises a first group consisting of M1, M2, M3 in the first row, a second group consisting of M4, M5, M6 in the second row, a third group consisting of M7, M8, M9 in the third row, a fourth group consisting of M10, M11, M12 in the fourth row, and a fifth group consisting of M13 of the fourth column and M14 of the fifth column.

Where there is a special event, the order matrix will have an additional group, namely, a sixth group. Referring to FIG. 2C, an example special event order matrix comprises cells M19-26 which form the six group.

A special event is one where a player needs to draw an additional tile and the total number of tiles is more than the predetermined initially allocated number of tiles, that is, 14 tiles.

In an example way of allocation, the processor will initial distribute the tiles according to a determined rule, for example, Dots, Bamboo, Character, winds (E, S, W, N), dragons (Chung (Red), Fat (Green), Pak (White)), seasons (spring, summer, autumn, winter), flowers (cherry blossom, orchid, chrysanthemum, bamboo stick). Where the tiles are number tiles, that is, tiles of the Dot suit, the Bamboo suit, or the Character suit, the processor may arrange in a descending or ascending order without loss of generality.

After the initial distribution, the processor will arrange the tiles into another ordered manner according to distribution rules to make scoring groups more recognizable.

In an example display order arranged according to example distribution rules, the processor is to re-arrange the tiles according to predetermined priority rules, for example:

Identify identical tiles forming a 3-tile scoring group ('Pong meld' or 'Pong group') and fill a top row or top rows with the Pong meld or Pong melds, Identify sequential numbered tiles of the same suit forming a 3-tile scoring group ('Chow meld' or 'Chow group') after completion of 'Pong group' filling, Identify twin tiles forming a 2-tile group ('eye meld' or 'eye group') and fill them in the fifth group, Remaining twin tiles are placed such that identical tiles are adjacent each other, Remaining sequentially number tiles are arranged in a sequential order, Remaining tiles are filled into the remaining cells.

After the above initial ordering distribution or ordered allocation, the processor will generate a supplemental draw of tiles on detection of a special event or a declared special event. After the supplemental drawing of tiles, the tiles will be ordered according to predetermined arrangement rules, for example, Identical tiles forming a 4-tile scoring group ('Kong meld' or 'Kong group') are arranged in the same row, with the $4^{th}$ tile placed in a group six cell.

Where a tile is moved out of a cell to form a 4-tile group, the outstanding cell will be replaced by the supplemental tile drawn after the initial draw, Bonus tiles such as flower or season tiles will be moved to a group six cell.

After the ordering allocation of tiles into the individual matrix cells has been performed, the processor will proceed to score calculation to reward the player, and achievements can be appreciated, but visually, intellectually, and otherwise.

In an example scoring mechanism, the scoring is according to the scoring groups that can be formed according to the tiles in possession, that is, according to the tiles currently allocated to the player or the player account.

For example, where six sequentially numbered Bamboos tiles are in possession of the player after completion of the initial draw or after completion of supplemental draws, as depicted in FIG. 3A, four 3-tile 'Chow type' scoring groups can be formed, as depicted in FIG. 3B. In this example, the set of six Bamboo tiles comprises a single numbered 4 Bamboo tile, and the common tile is a constituting tile of both a first scoring group consisting of Bamboo tiles 3-4-5 and a second scoring group consisting of Bamboo tiles 4-5-6. Thus, the common tile ("Bamboo 4") appears twice in the two alternative scoring groups.

Likewise, the common tile ("Bamboo 7") is a constituting tile of both a third scoring group consisting of Bamboo tiles 5-6-7 and a fourth scoring group consisting of Bamboo tiles 6-7-8. Thus, the common tile ("Bamboo 7") appears twice in the two alternative scoring groups. In this example, the first and second scoring groups are first alternative scoring groups, and the third and fourth scoring groups are second alternative scoring groups.

In an example scoring rule, a score is attributed to each scoring group, even though the scoring groups are alternative scoring groups. An alternative scoring group is one wherein at least one member is also a member of another scoring group.

Another example set of tiles depicted in FIG. 4A consists of six sequentially numbered Character tiles, where there are three 'Character 4' tiles, and one each of Character '5', '6' and '7' tiles. In this example, five possible scoring groups can be formed, as depicted in FIG. 4B. With the five possible scoring groups, five scores will be awarded and the processor will credit the scores to the player sequentially, so that the individual awards are notable by a human player.

To assist a player or to make the process more noticeable or transparent, the processor will move a scoring group out of or away from the order matrix. For example, the group is moved upwards or sideways from the order matrix to make in more salient. Where the scoring groups comprise alternative scoring groups, the process will display the alternative scoring groups in a sequential manner, with or without rearrangement in the order matrix.

Referring to an example interactive process as depicted in FIG. 5A, the processor after receipt of activation signal from a player allocates a predetermined set of tiles to a player. The 14 initially allocated tiles are arranged in an order matrix, as depicted in FIG. 5A. The processor will next execute stored instructions to arrange the tiles according to a predetermined order and/or priority, as depicted in FIG. 5B.

The process after performing the ordering of tiles will rearrange the tiles according to determined rules of ordering and redistribute the tiles in the order as depicted in the order matrix of FIG. 5B. In this arrangement, the first row of 3 "Bamboo 7" tiles form a first scoring group and the second row of "Character 9" tiles form a second scoring group, otherwise there is no other possible scoring group.

Upon detection of a special event, in this event, a cherry blossom tile and a fourth 'Character 9' tile, a supplemental draw is made, the cherry blossom tile is moved to cell M19, that is one of the group 6 cells, and the four 'Character 9' tile are to appear on the same row, the second row, as depicted in FIG. 5C.

After the supplemental draw, the processor is to rearrange the tiles, as a third 'Fat' tile and a second "Dot 1" have been drawn during the supplemental draw. After this rearrangement, the arrangement is depicted in FIG. 5D, with the "Dot 1" pair becoming an eye pair and the "Fat" pair moved into the third row to join the newly drawn third "file" tile to form a "Pong" group of "Fat" tiles.

After this final re-shuffling of tiles following the supplemental draw, the processor will proceed to compile and extract possible scoring groups and move the scoring groups, for example, individually, collectively, and/or sequentially, to provide player information or notification of scoring.

In another example interactive process as depicted in FIG. 6A, the processor after receipt of activation signal from a player allocates a predetermined set of tiles to a player. The 14 initially allocated tiles are arranged in an order matrix, as depicted in FIG. 6A. The processor will next execute stored instructions to arrange the tiles according to a predetermined order and/or priority, as depicted in FIG. 6B.

The process after performing the ordering of tiles will rearrange the tiles according to determined rules of ordering and redistribute the tiles in the order as depicted in FIG. 6B.

In this arrangement, the first row of 3 "Character 3" tiles form a first scoring group, the second row of "Character 1-2-3" tiles form a second scoring group, the "Character 2-3-4" tiles form a third scoring group and the 'Character 3-4-5' for a fourth scoring group, otherwise there is no other possible scoring group.

Upon detection of a special event, in this event, an 'orchid 2' tile and a fourth 'Character 3' tile, a supplemental draw is made, the orchid tile is moved to cell M19, that is one of the group 6 cells, and the four 'Character 3' tile are group together in the same row, namely, the first row, as depicted in FIG. 6C.

After the supplemental draw, the processor is to rearrange the tiles, as a 'Character 6' tile and a "summer" or "season 2" have been drawn during the supplemental draw.

After this rearrangement, the arrangement is depicted in FIG. 6D, with the 'Character 4-5' tiles moved from the bottom row to the second row so that "Character 4-5-6" Chow group is in the second row and the original second and third row tiles shifted one row down.

With the drawing of the supplemental bonus tile "summer" or "season 2" during the first supplemental draw, an additional supplemental draw is necessary and the distribution, reallocation and rearrangement process is repeated after this supplemental draw, as depicted in FIGS. 6D and 6E.

After this final re-shuffling of tiles following the second supplemental draw, the processor will proceed to compile and extract possible scoring groups and move the scoring groups, for example, individually, collectively, and/or sequentially, to provide player salient information or salient notification of scoring.

Each tile is effectively an information bearing device, which when standing alone or as a group, can contribute to scoring. A scoring group may comprise 2, 3 or 4 tiles. In some embodiments, a scoring group may comprise more than 4 tiles, for example, 14 tiles or even more, when a hand comprise more than 14 tiles, for example, in the Taiwan form.

In some embodiments, a player may select to continue the process after scores have been awarded or not, depending whether there are any scoring groups in the tiles drawn.

To continue, a player may elect to proceed using the undrawn tiles of the deck of tiles or to proceed using a new deck of tiles. For example, if a single hand has been drawn, 130 remaining tiles out of the 144 tiles would be available, and if two hands have been drawn, 116 remaining tiles would be available for distribution, for example random distribution, by the processor without loss of generality.

To continue process after score determination and display, the processor will generate a prompt and a player will react using the player interfacing device to enter the player's selection.

Where a player has elected to continue using remaining tiles, the processor may start a timer to limit time between adjacent set of processes, since a player may use the window of time to work out what are the remaining tiles to determine whether it is more beneficial to continue with remaining tiles or to start afresh with a new deck.

On the other hand, a process involving use of remaining tiles would be beneficial to help a player perform intellectual exercise and improve the player's memory, response, physical coordination and/or responsiveness without loss of generality.

Predetermined payout or award rules may be set.

For example, a rewarding scoring threshold may be set. For example, a player may need to meet a scoring threshold in order to gain an actual reward or credit, even though there are scoring groups present in a hand of tiles.

In some embodiments, the scoring threshold can vary according to the actual wager a player place. For example, a higher wager would mean a lower scoring threshold or vice versa.

In some embodiments, a player may elect to play using two separate hands of tiles.

In some embodiments, a player may elect to play with a side bet.

For example, a player may elect to make a side bet on whether there will be any bonus tiles, the number of bonus tiles, whether there will be any 'Kong' group, whether there are any 'Kong group' of a specific tile suit or a specific plurality of specific tile suits, etc.

The side bet may link to the outcome of the main process or may be independent to the main process.

In some embodiments, the method may include the use of a wild card or a scatter symbol to increase complexity or interest level.

Inclusion of a wild card element would appear to help a player to achieve scores more easily so that confidence can be built to prepare for advancement into a more advanced level.

The use of wild card elements would appear to mimic operations of traditional cell machines for better player friendliness and to help players move away from cell machines which are usually not readily accessible to everyday or domestic environments.

In some embodiments, a scatter symbol or a plurality of scatter symbols may be included. For example, a scatter symbol may be used to trigger optional or extra features such as auto sorting or tile holding. A scatter symbol may be a wildcard or a bonus symbol. For example, the scatter symbol may pop up in the screen at random or at selected time intervals.

Auto Sorting

Player would get into this feature mode once they have the scatter symbol in the last spin. Within the feature, player would be assigned a certain number of free spins, tiles generate by the system for each spin would be decreased when player gets any meld, a big prize would be given to player if the winning hand is formed through the free spins.

Example process and operations of this feature are depicted in FIGS. 7A, 7A1, 7B, 7B1, 7C, 7C1, 7D, 7D1, and 7E.

Figure 7C:
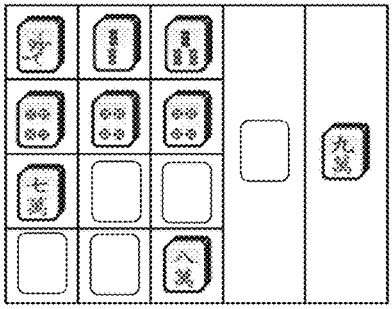
Figure 7D:
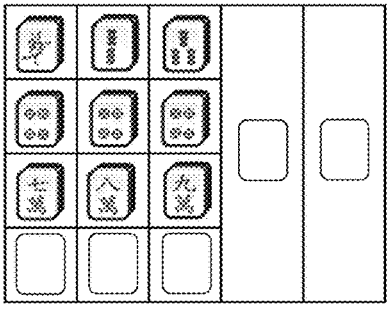
Figure 7D:
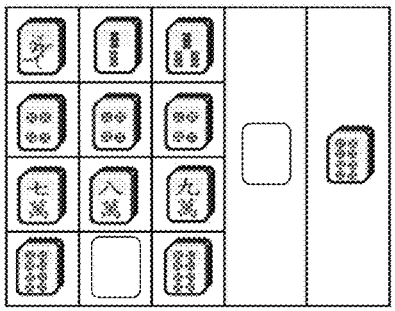
Figure 7E:
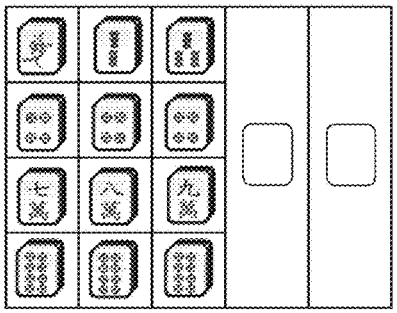

Initially, a hand of tiles is issued to the player. The player may elect to lock a meld or a plurality of melds which forms a scoring event, a scoring group or a plurality of scoring events or scoring groups. After an initial set of selected tiles has been locked, as depicted in FIG. 7A, the locked tiles will be retained and deployed in a first row, as depicted in FIG. 7A1. The player will then send a redraw signal to the machine to have the unlocked tiles replaced by newly drawn tiles. After new tiles have been drawn and issued to the Player to replace the freed or non-locked tiles, the player will elect to lock a meld or a plurality of melds among the newly drawn tiles which forms a scoring event, a scoring group or a plurality of scoring events or scoring groups, as depicted in FIG. 7B, and the elected tiles will be deployed in a second row, as depicted in FIG. 7B1. The process will continue after all the free spin chances have been used or after all the tile have been locked and the total scores will be calculated on the basis of the finally locked tiles, as depicted in FIGS. 7C1, 7D, 7D1, and 7E.

Tile Holding

When in this feature mode, which is for example a bonus mode, a player will be issued an Eye pair and then three blocks of tiles sequentially. Each block comprises 4 melds of Pong tiles arranged into three rows. Each of the melds may be generated randomly, pseudo-randomly or according to pre-calculated rules. After the eye pair has been distributed, a first block of Pong tiles will be issued to the player. The player would need to select and hold one of the three melds of Pong tiles forming the first block. After a player has selected and hold a second meld. A second block of Pong tiles will be issued to the player. The player would need to select and hold one of the three melds of Pong tiles forming the second block. After a player has selected and held a third meld. A third block of Pong tiles will be issued to the player. The process will continue until all four melds have been selected by the player to form a winning hand. After the four melds have been selected and held, a winning hand is formed, the award is calculated according to predetermined rules of award and the total award of credits depends on the meld selections made. In some embodiments, each block may comprise melds of Chow and/or Pong, Pongs only or Chows only with loss of generality.

As there are three melds in a block which are available for selection, there are a total of 81 possible combinations and the combinations would affect the actual total payout. Furthermore, the total payout is dependent on the melds forming a winning hand, and subsequently issued melds would affect the total award value. Therefore, a player would need to make a decision interactively upon being issued of the instant block for selection to aim for possible higher scores. An example process flow and operations of this feature are depicted in FIGS. 8A to 8G.

Initially: a pair of tiles forming an eye is assigned to player, as depicted in FIG. 8B.

Next: player would select the 1st meld from 3 melds forming a first block, as depicted in FIG. 8C.

Next: player would select the 2nd meld from 3 melds forming a second block, as depicted in FIG. 8D.

Next: player would select the 3rd meld from 3 melds forming a third block, as depicted in FIG. 8E.

Next: player would select the last meld from 3 melds forming a fourth block, as depicted in FIG. 8F.

Final result: payout refer to the winning hand pattern from pay-table, as depicted in FIG. 8G.

A player may be given an opportunity to place more control on the outcome of the process in variants of the process. In some embodiments, a player may be given an opportunity to exercise an option to replace one tile or a plurality of tiles at a cost. For example, upon distribution of the initial hand of tiles by the microprocessor, a player may elect to exercise an option to replace an elected tile or a plurality of elected tiles at a cost or a price. To facilitate such an option, an option icon, for example, an icon marked "Replace" may be displayed on a display region of the display screen, for example, on a background portion of the display screen which is outside and separate from the tile distribution matrix. To exercise the replacement option, a player may bring a control means, for example, the cursor of a mouse or a joystick, to an unwanted tile and click when the cursor is within the tile to elect the tile or the tiles sequentially, and then click the "Replace" icon to activate the replacement process. Upon detection of a click on the "Replace" icon, the microprocessor will proceed to draw and distribute a replacement tile or a plurality of replacement tiles to replace the unwanted tile or unwanted tiles. In some embodiments, the process may include a complimentary option or two complimentary options as an incentive. Since the player has increased control over the process, a player would have more opportunities to make decisions and enhance mind exercise with hand coordination to facilitate control of the election and replacement process. The process may be devised so that the replacement option can be exercised before or after the re-organization of tiles without loss of generality.

While the present disclosure has been described with reference to the example and figures, the example and figures are non-limiting examples only.

While Mahjong, Mahjong tiles and Mahjong rules have been used as examples herein, Mahjong, Mahjong tiles and Mahjong rules are to provide non-limiting examples without loss of generality. For example, the method and apparatus herein can apply to Pai Gow or other tile game forms or poker or other cards game form without loss of generality.

The invention claimed is:

1. A method of interaction involving a machine and a player or a plurality of players, the method comprising:

the machine selecting a plurality of information bearing devices from a deck comprising a predetermined plurality of available information bearing devices to form a hand of playing devices upon a player making an initiation request to the machine, wherein each playing device is an information bearing device selected from the predetermined plurality of available information bearing devices by the machine;

the machine sending the playing devices to an electronic display apparatus representing the player, and displaying the playing devices on a display screen of the electronic display apparatus, wherein the playing devices are distributed in a distribution matrix which is formed on a first display region of the display screen;

the machine moving a scoring combination out of an allocated position on the distribution matrix into a second display region of the display screen which is outside the first display region, wherein the scoring combination comprises a playing device or a plurality of playing devices and carries a predetermined score value;

the machine maintaining a first counter and incrementing the first counter by a value corresponding to the predetermined score value; and the machine moving the scoring combination back to the allocated position.

2. The method of claim 1, wherein the distribution matrix comprises a plurality of rows of cells and a plurality of columns of cells, and each playing device is to be placed in a single cell; and wherein the machine is to distribute the playing devices according to predetermined distribution rules.

3. The method of claim 2, wherein the machine is to select the playing devices according to a drawing sequence, and the machine is to place the playing devices into the cells of the distribution matrix according to the drawing sequence.

4. The method of claim 3, wherein the machine is to reorganize the playing devices after the playing devices are first placed at initial cell locations inside the distribution matrix; and wherein the playing devices are reorganized according to the predetermined distribution rules.

5. The method of claim 4, wherein the machine is to shuffle and shift the playing devices from the initial cell locations inside the distribution matrix to destination cell locations inside the distribution matrix by shuffling and/or shifting movements; and wherein the shuffling and/or shifting movements are displayed on the display screen.

6. The method of claim 2, wherein the distribution matrix comprises a base matrix and an expanded matrix, and the machine is to perform a supplemental draw of playing devices if the hand comprises a featured device; and wherein the machine is to place the playing devices into the expanded matrix following the supplemental draw.

7. The method of claim 6, wherein the expanded matrix comprises a bonus matrix which is detached from the base matrix, and the supplemental draw is required if the hand comprises a bonus device; wherein if the featured device comprises a bonus device, the machine is to move the bonus device from the base matrix to the bonus matrix following a movement path; and wherein the movement path is displayed on the display screen and visible to a player and the movement path traverses across the base matrix.

8. The method of claim 1, wherein the first counter is a main counter showing a credit balance of a player, and the machine is to deduct a value corresponding to the value of a bet made by the player from the credit balance upon receipt of the initiation request to form an updated credit balance; and wherein the machine is to display the updated credit balance on the first counter on the display screen.

9. The method of claim 1, wherein the machine maintains a second counter, the second counter is to display the predetermined score value.

10. The method of claim 1, wherein the scoring combination forms a scoring event and the machine maintains a second counter which is displayed on the display screen, and wherein the second counter shows the predetermined score value.

11. The method of claim 1, wherein the scoring combination forms a scoring event and the scoring event having a nomenclature; and wherein the nomenclature is displayed on the second display region of the display screen.

12. The method of claim 1, wherein the machine is to move the scoring combination out of the distribution matrix for making a scoring presentation of the scoring combination in the second display region, and to move the scoring combination back into the allocated position after the scoring presentation; and wherein the scoring combination is moved in a bouncy manner.

13. The method of claim 1, wherein when the playing devices can be grouped into a plurality of alternative scoring combinations, the machine is to present all the alternative scoring combinations individually and sequentially on the display screen.

14. The method of claim 13, wherein the machine is to increment the first counter by a value corresponding to the predetermined score value upon presentation of each alternative scoring combination on the display screen.

15. The method of claim 1, wherein the information bearing devices are simulated Mahjong tiles and the playing devices are simulated Mahjong tiles selected from a complete deck of Mahjong.

16. A gaming machine comprising a solid-state microprocessor, data storage devices, user interface means and a video display unit; wherein the microprocessor is to execute stored instructions:

to select a plurality of information bearing devices from a deck comprising a predetermined plurality of available information bearing devices to form a hand of playing devices upon a player making an initiation request to the machine, wherein each playing device is an information bearing device selected from the predetermined plurality of available information bearing devices by the machine;

to send the playing devices to an electronic display apparatus representing the player, and to display the playing devices on a display screen of the electronic display apparatus, wherein the playing devices are distributed in a distribution matrix which is formed on a first display region of the display screen;

to move a scoring combination out of an allocated position on the distribution matrix into a second display region of the display screen which is outside the first display region, wherein the scoring combination comprises a playing device or a plurality of playing devices and carries a predetermined score value;

to maintain a first counter and to increment the first counter by a value corresponding to the predetermined score value; and to move the scoring combination back to the allocated position.

17. The gaming machine of claim 16, wherein the distribution matrix comprises a plurality of rows of cells and a plurality of columns of cells, and each playing device is to be placed in a single cell; and wherein the apparatus is to distribute the playing devices according to predetermined distribution rules; and wherein the microprocessor is to move the scoring combination out of the distribution matrix for making a scoring presentation of the scoring combination in the second display region, and to move the scoring combination back into the allocated position after the scoring presentation; and wherein the scoring combination is moved in a bouncy manner.

18. The gaming machine of claim 16, wherein when the playing devices can be grouped into a plurality of alternative scoring combinations, and the machine is to present all the alternative scoring combinations individually and sequentially on the display screen.

19. The gaming machine of claim 18, wherein the machine is to increment the first counter by a value corresponding to the predetermined score value upon presentation of each alternative scoring combination on the display screen.

20. The gaming machine of claim 16, wherein the machine is to reorganize the playing devices after the playing devices are first placed at initial cell locations inside the distribution matrix; and wherein the playing devices are reorganized according to the predetermined distribution rules; and wherein the machine is to shuffle and shift the playing devices from the initial cell locations inside the distribution matrix to destination cell locations inside the distribution matrix by shuffling and/or shifting movements; and wherein the shuffling and/or shifting movements are displayed on the display screen.

* * * * *